United States Patent [19]

Smith et al.

[11] 4,184,536

[45] Jan. 22, 1980

[54] HEAT REJECTION SYSTEM

[75] Inventors: Gregory C. Smith; Richard D. Tokarz; Harvey L. Parry, Jr.; Daniel J. Braun, all of Richland, Wash.

[73] Assignee: The United States of America as represented by the United States Department of Energy, Washington, D.C.

[21] Appl. No.: 880,254

[22] Filed: Feb. 22, 1978

[51] Int. Cl.[2] ..... F28D 21/00

[52] U.S. Cl. ..... 165/1; 165/39; 165/40; 165/140; 165/DIG. 1; 261/DIG. 11

[58] Field of Search ..... 165/DIG. 1, 140, 141, 165/39, 1, 110, 40; 261/DIG. 11

[56] References Cited

U.S. PATENT DOCUMENTS

| | | | |
|---|---|---|---|
| 2,181,354 | 11/1939 | Winters | 165/141 |
| 2,858,677 | 11/1958 | Stone | 165/141 |
| 3,788,385 | 1/1974 | Delahunty | 165/DIG. 1 |
| 3,851,702 | 12/1974 | Heller et al. | 165/110 |
| 3,935,902 | 2/1976 | Heller et al. | 165/110 |

FOREIGN PATENT DOCUMENTS

| | | | |
|---|---|---|---|
| 2259902 | 8/1975 | France | 165/DIG. 1 |

*Primary Examiner*—Sheldon Richter
*Attorney, Agent, or Firm*—R. V. Lupo; Frank H. Jackson

[57] ABSTRACT

A cooling system for rejecting waste heat consists of a cooling tower incorporating a plurality of coolant tubes provided with cooling fins and each having a plurality of cooling channels therein, means for directing a heat exchange fluid from the power plant through less than the total number of cooling channels to cool the heat exchange fluid under normal ambient temperature conditions, means for directing water through the remaining cooling channels whenever the ambient temperature rises above the temperature at which dry cooling of the heat exchange fluid is sufficient and means for cooling the water.

5 Claims, 5 Drawing Figures

HEAT REJECTION SYSTEM

CONTRACTUAL ORIGIN OF THE INVENTION

The invention described herein was made in the course of, or under, a contract with the U.S. DEPARTMENT OF ENERGY.

BACKGROUND OF THE INVENTION

This invention relates to a cooling system for rejecting waste heat. In more detail, the invention relates to a cooling system for rejecting waste heat from a thermal-electric power plant incorporating a cooling tower adapted to dry operation under normal ambient temperature conditions but including combination cooling capability for use on hot summer days.

As the world demand for electrical power increases, more and larger thermal-electric power plants are being built to meet this need. Of these plants, even the most efficient are capable of converting only about 40% of their heat input into electricity. The remaining 60% of this heat is wasted and must be expelled to the environment. This has usually been accomplished by circulating a large flow of water from a natural source such as a river, lake, or sea, through the plant's steam condenser, and then returning the water to its source after its temperature has been raised by the hot condensing steam. The wisdom of this procedure has been opened to question due to environmental and ecological problems stemming from the temperature rise caused in the natural source.

To avoid this "thermal pollution" of natural bodies of water, alternative methods of cooling power plants have been devised. These include man-made cooling ponds and lakes, spray ponds and spray canals, evaporative cooling towers, and dry cooling towers. Man-made cooling ponds and lakes function similarly to their natural counterparts. Spray ponds and canals and evaporative cooling towers function by flowing water through the plant steam condenser and then cooling the heated water back down to its original temperature by causing a sufficiently large portion of the flow to evaporate, carrying the waste heat into the atmosphere. The cooled water is then recirculated through the plant condenser. All of these wet systems consume large quantities of water to replace the water that is evaporated into the air.

In dry cooling tower systems, the water does not come into contact with the air, and thus does not evaporate. Instead it flows through the inside of the tubes of a large heat exchanger (dry cooling tower) and transmits its thermal energy through the tube walls to a stream of air that is caused to flow over the outside of the tubes (similar to the familiar automobile radiator). Because the system is closed to the atmosphere, fluids other than water may be used to carry the thermal energy from the plant condenser to the cooling tower. Studies have shown that it may be economically favorable to use ammonia instead of water in dry cooling systems. In such systems, liquid ammonia would be vaporized by the hot condensing plant steam and would then be transported as a vapor to the cooling tower where it would be condensed back to a liquid by the cool air flowing through the tower.

Both wet (evaporative) and dry cooling tower schemes have their own definite advantages and disadvantages. As already mentioned, dry cooling towers have the advantage that cooling water is not evaporated into the atmosphere, so that the consumptive use of water is negligible. This advantage would be particularly important in arid areas where water may be too scarce to support an evaporative system, or in locations where large quantities of water evaporated into the atmosphere might cause fog and ice which could be a safety hazard as well as environmentally and aesthetically objectionable.

The major drawback to dry cooling systems is their inability to reject heat to the atmosphere as cheaply and efficiently as wet systems, particularly on hot summer days when power demands in many countries (such as the United States) are likely to be highest and plant cooling capacity is most needed.

To best make use of the advantages of both wet and dry systems, a combination cooling system is commonly used that incorporates the high heat rejection potential of evaporative systems, yet does not result in the high evaporative losses and other attendant problems of totally wet systems. Even in areas where water resources are scarce, the heat rejection capability of wet cooling is so superior to that of dry cooling that there are strong incentives to augment dry cooling towers through evaporative cooling on hot days using any water that may be available at the plant site. By such use of combined dry-wet cooling systems, the plant performance can be significantly improved at the price of only a relatively small consumptive use of the available water resource as compared to usage of wet cooling only.

Several methods have been devised to combine dry and wet cooling systems. These currently include (1) separate dry and wet towers, (2) integrated dry and wet towers, (3) dry tower-cooling pond arrangements, and (4) deluge water augmented dry towers. A brief description of each of these systems follows.

1. Separate Dry and Wet Tower

This system simply employs a wet tower along with a separate and distinct dry tower.

2. Integrated Dry and Wet Tower

In an integrated system, the wet tower portion and dry tower portion are physically contained within the same tower structure. The water flow sequence can be the same as for separate dry and wet towers.

3. Dry Tower-Cooling Pond Arrangements

This system is similar to the separate dry and wet tower system, except that a cooling pond replaces the wet tower.

4. Deluge Water Augmented Dry Tower

In this system the flow from the plant condenser passes through a dry tower only. In hot weather the heat rejection capability of the dry tower is increased by deluging or spraying water over the outside of the tower heat exchanger and allowing some of it to evaporate into the air stream.

In addition, in light of the fact that dry cooling systems using ammonia are projected to be less expensive than dry cooling systems using water, only the deluge water augmented dry tower or a separate condenser loop system would have the capability of combining the advantages of wet cooling with that of the less expensive ammonia dry system. The deluge augmentation system is, however, the only currently viable choice for use with an ammonia system, since a special expensive condenser is required in the separate condenser loop system.

There are, however, some major drawbacks to deluge augmented dry tower systems. Some of these are:

1. Buildup of scale on the tower finned cooling surfaces caused by the evaporation of water from these surfaces may seriously degrade the heat rejection performance of the dry tower and requires expensive maintenance and downtime. This method also requires extensive treatment of the delugeate water to reduce the rate of scale buildup.

2. Deluging the outside of the tower heat exchanger with water may significantly cut down the heated surface area with which the air can come in contact. The degree to which this would occur would depend upon the type of heat exchanger surface employed in the dry tower, but for some types of surfaces this effect may actually degrade the performance of the tower rather than augment it.

3. Heat exchanger surfaces which may be most economical for dry tower application may not be suitable for augmentation. This is a complex relationship with many interdependent factors which affect the economics of the cooling tower.

4. Moisture on the outside of the heat exchanger may contribute significantly to its rate of corrosion, leading to early replacement of the cooling surface.

5. Dimensions of the heat exchanger and application of augmentation water must be carefully controlled so as to keep the entire surface wet while operating to inhibit excessive scaling and at the same time prevent excessive holdup of the water at the top of the heat exchanger which would block the flow of air to heat transfer surfaces in that portion.

SUMMARY OF THE INVENTION

A cooling system for rejecting waste heat consists of a cooling tower incorporating a plurality of coolant tubes provided with cooling fins and each having a plurality of cooling channels therein, means for directing a heat exchange fluid from the power plant through less than the total number of cooling channels to cool the heat exchange fluid under normal ambient temperature conditions, means for directing water through the remaining cooling channels whenever the ambient temperature rises above the temperature at which dry cooling of the heat exchange fluid is sufficient and means for cooling the water.

DETAILED DESCRIPTION OF THE INVENTION

Figure 1:
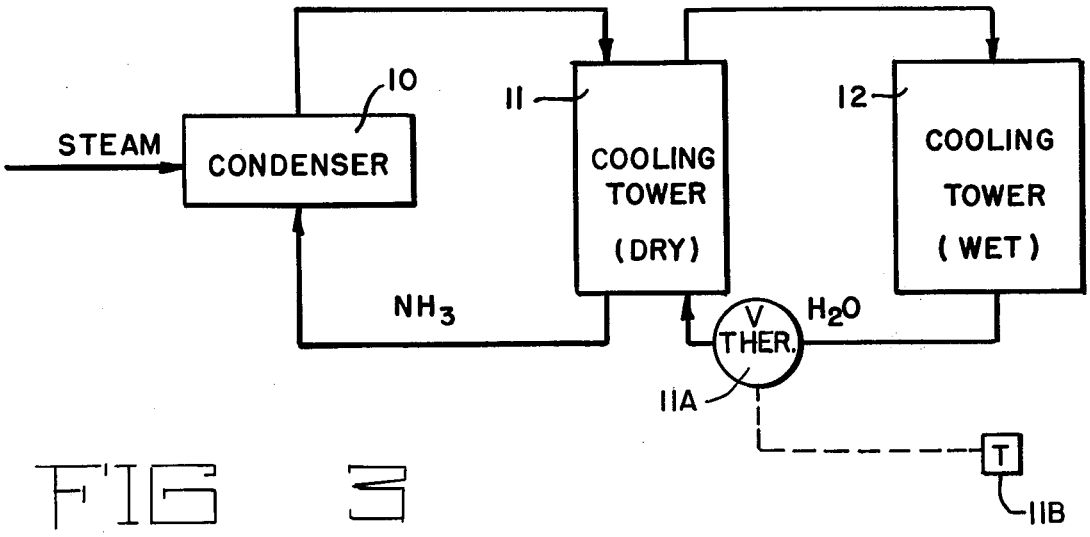
FIG. 1 is a block diagram of a cooling system which in further detail constitutes the present invention.
Figure 3:
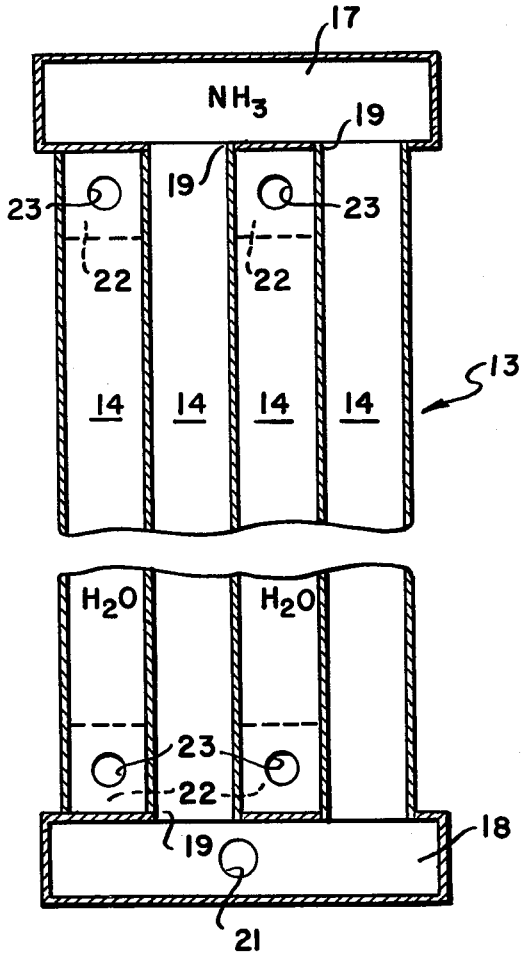
FIG. 3 is a vertical section taken on the line 3—3 of FIG. 2.
Figure 2:
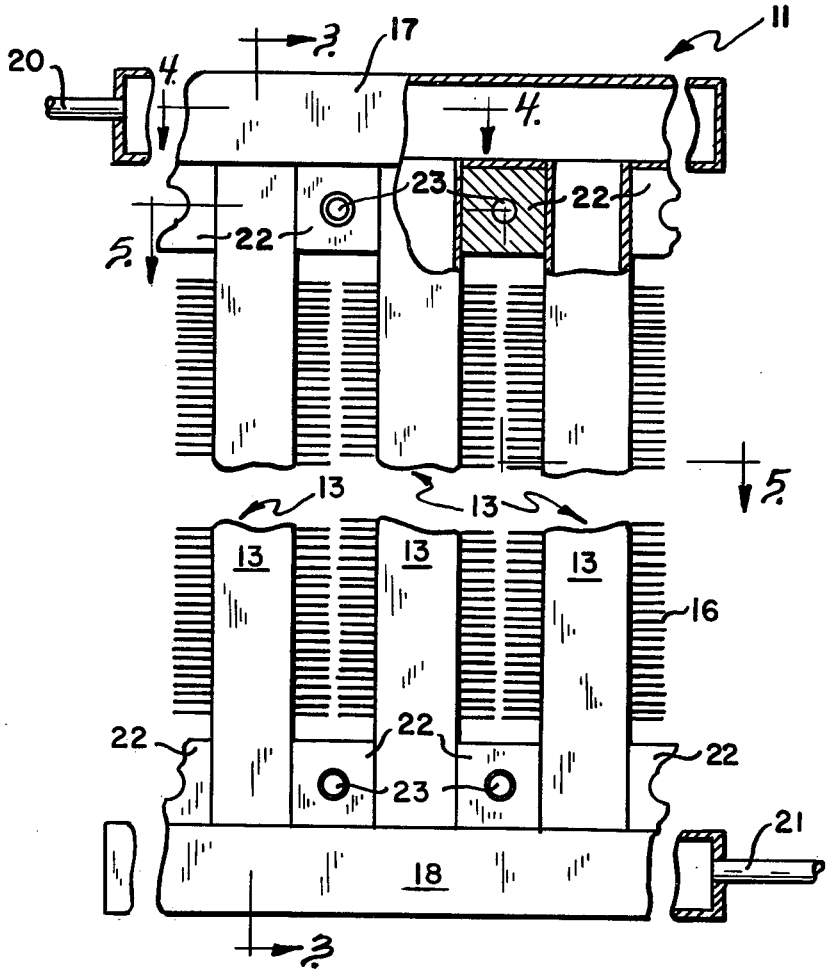
FIG. 2 is an interrupted vertical elevation, partly broken away, of an illustrative portion of a cooling tower constituting an important feature of the cooling system of the present invention.
Figure 4:
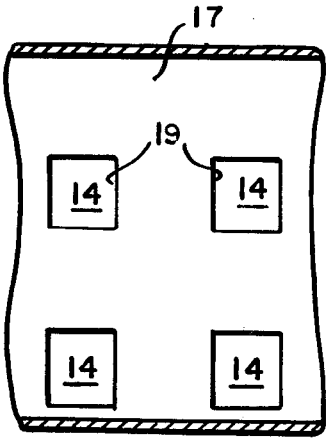
FIG. 4 is a horizontal section taken on the line 4—4 of FIG. 2.
Figure 5:
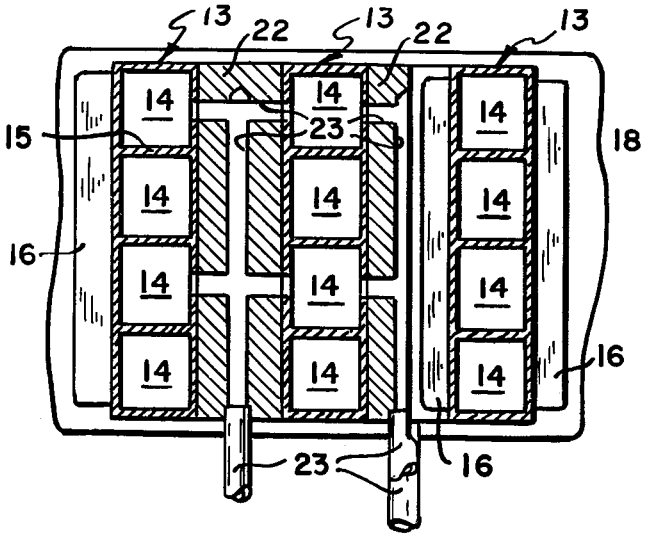
FIG. 5 is a horizontal section taken on the line 5—5 of FIG. 2.

Referring first to FIG. 1, steam from any source of heat such as a thermal-electric power plant is cooled in condenser 10 by heat exchange with a heat exchange fluid such as ammonia or other refrigerant or water. The heat exchange fluid is vaporized in condenser 10 by the heat of the steam and condensed in cooling tower 11 which under normal ambient temperature conditions is operated as a dry cooling tower with heat exchange to the atmosphere. It should, of course, be possible to condense the steam from the power plant directly in cooling tower 11, eliminating use of an intermediate heat exchange fluid.

When the ambient temperature is above that temperature at which dry cooling by heat exchange with the atmosphere is adequate, water is flowed through separate channels in cooling tower 11 to provide additional cooling of the heat exchange fluid as will be described in detail hereinafter. This may be accomplished in conventional fashion as by employing a valve 11A in the water line leading to cooling tower 11 controlled by a temperature sensor 11B which senses the temperature of the ambient air or, preferably, of the heat exchange fluid. This water may be cooled by evaporation to the atmosphere in cooling tower or pond 12 or by any other means such as direct heat transfer to a river.

Referring next to FIGS. 2 to 5, cooling tower 11 includes an array of cooling tubes 13 of generally rectangular cross section, each divided into a plurality of coolant channels 14 of the same size by transverse partitions 15. Preferably cooling tubes 13 are vertical as shown. However, other orientation is possible. Cooling tubes 13 provide on each of opposite sides thereof a substantially continuous, broad and flat external surface to each of which is secured a plurality of vertically spaced, horizontal, thermally conductive fins 16, the fins on adjacent cooling tubes closely approaching one another. The heat transfer surfaces are provided with fins from a point a short distance below the top of the cooling tubes to a point a short distance above the bottom of the cooling tubes.

Headers 17 and 18 respectively overlie and underlie the array of coolant tubes and have openings 19 therein which register with the top and bottom respectively of alternate cooling channels 14. Header 17 is provided with an inlet 20 for heat exchange fluid from condenser 10 and header 18 is provided with an outlet 21 for returning heat exchange fluid to condenser 10.

Water is supplied to the bottom of the remaining alternate cooling channels 14 and thus flows countercurrent to the ammonia. The number of cooling channels to which water is supplied will depend on the amount of auxiliary cooling required. For example, one channel in each tube may be enough. The single channel should be at the back of the tube as air flows past the tube to avoid interfering with air cooling. Also, as shown, alternate cooling channels may be supplied with water. Aluminum blocks 22 disposed between channels 14 between the top fin 16 and header 17 and between the lower fin 16 and header 18 are counter drilled and cross drilled to provide water channels 23 leading to the bottom of channels 14 and from the top of channels 14. Ideally water will remain in these alternate cooling channels 14 at all times for greater cooling efficiency.

Ammonia is the preferred heat exchange fluid and would desirably be employed at a pressure of 300–350 psi. It would also be possible to use water as the heat exchange fluid and, in addition, as has been said, it would be possible to use the steam developed in the thermal-electric power plant as the heat exchange fluid; that is, conduct the steam directly to the cooling tower 11.

The system according to the present invention possesses most of the same advantages that the deluge augmentation system has over the other currently available combined dry and wet cooling systems. It would, however, be an important improvement over the deluge augmentation concept according to the following features:

1. Scaling and corrosion of the dry tower heat exchanger surfaces are eliminated in our system, since the augmentation water flows on the inside of the heat exchanger tubes rather than over the fragile finned outside surfaces, and evaporation occurs in a separate wet tower or pond designed for that purpose. Dry tower surfaces remain clean and dry. Water treatment cost and maintenance are minimized.

2. Unlike a deluge water augmented dry tower system, the performance of the dry cooling tower of our system could not be inhibited by the flow of the augmentation water. The area open to cooling air flow is not decreased nor blocked by water deluging the heat exchanger surfaces.

3. Since temperature remains constant during the process of condensation, the rate of heat rejection (a function of how hot the tower is) to the air from a dry tower condensing ammonia, another refrigerant, or the plant steam would not be decreased by the presence of augmentation water flowing in separate channels of the heat exchanger tubes. Presence of the augmentation water would serve only to increase the rate of condensation and thus assist the dry tower in rejecting the plant waste heat. Essentially full capacity of the dry tower is maintained.

4. Restrictions on heat exchanger dimensions and orientation would be minimal so that the dry tower could be designed for optimum year-round performance.

5. Control of our system would be very simple and straightforward, allowing close regulation of the amount of water allowed to evaporate into the atmosphere, minimum expenditures of augmentation water pumping power, and optimum performance of the heat rejection system for given weather conditions. Changes in plant power level or ambient weather conditions can be followed with a smooth change in heat rejection. This may be difficult to achieve in a deluge system which must be controlled by turning on and off the deluge flow to finite sections of the tower, causing abrupt changes in its heat rejection capacity.

6. The augmentation water piping network is very likely to be less expensive for our system than for a system utilizing the deluge method of augmentation. The figures show a simple and inexpensive way to direct the augmentation water into the separate channels of the heat exchanger tubes. Special nozzles and troughs would not be required.

7. Unlike a deluge augmented system using ammonia (or steam) as the primary heat transport fluid, our ammonia system could utilize a thermal energy storage pond to provide added efficiency in operational and capital costs. A thermal energy storage pond works as follows. For a few hours a day when the peak heat load from the plant is high and the small wet cooling tower cannot fully augment the dry cooling tower, part of the heated augmentation water is channeled off and stored in a pond. When the plant load has eventually decreased and augmentation of the dry tower is no longer necessary, the hot pond water can then be sent through the wet cooling tower and cooled back down to be ready for reuse the next day.

Our system can be viewed as a separate dry and wet tower system that utilizes known extruded tube designs to inexpensively combine the water saving advantages of dry cooling with the high performance advantages of evaporative cooling. The extra augmentation water channels within the extruded tubes can be made for little more than the cost of the additional wall material by simply extruding the tubes with whatever additional channels of whatever shapes and sizes are desired. This concept can be additionally enhanced and made less expensive by using ammonia as the dry tower primary heat transport fluid.

The embodiments of the invention in which an exclusive property or privilege is claimed are defined as follows:

1. In a method of rejecting waste heat from a power plant in which a heat exchange fluid is flowed in closed cycle relationship between the power plant and a cooling tower to reject the waste heat to the atmosphere, the improvement comprising flowing said heat exchange fluid through alternate flow paths in the cooling tower, maintaining stagnant water in the remaining flow paths under normal ambient temperature conditions, flowing said water through one or more of said remaining flow paths as the ambient temperature increases above that at which dry cooling of the heat exchange fluid along is adequate, the first of such flow paths through which water is flowed being at the back of the cooling tower with respect to the direction of flow of air through the cooling tower and evaporatively cooling the water.

2. A cooling system for rejecting waste heat from a power plant comprising a cooling tower incorporating a plurality of spaced cooling tubes, each of said tubes being divided into a single row of cooling channels, cooling fins on the exterior of said cooling tubes, means for directing a heat exchange fluid from the power plant in a closed cycle through less than the total number of channels in each tube for cooling the heat exchange fluid by heat exchange with the atmosphere under normal ambient temperature conditions, means for directing water through the remaining cooling channels when the ambient temperature is above the temperature at which atmospheric cooling of the heat exchange fluid is adequate and means for cooling the heated water.

3. System according to claim 2 in which the cooling tubes are vertically disposed and of generally rectangular cross section, the cooling fins are horizontal and in which alternate cooling channels contain heat exchange fluid, the remainder containing water.

4. A cooling system for rejecting waste heat from a power plant comprising a cooling tower incorporating a plurality of spaced, vertically disposed coolant tubes of generally rectangular cross section, transverse partitions extending across the tubes to divide the tubes into a row of cooling channels, horizontal cooling fins secured to the tubes, the cooling fins on adjacent ducts closely approaching one another, means for directing a heat exchange fluid from the power plant in a closed cycle through less than the total number of cooling channels in each coolant tube for cooling the heat exchange fluid by heat exchange with the atmosphere under normal ambient temperature conditions, means for directing water through at least one cooling channel in each coolant tube at the back of the tube as air flows through the tube when the ambient temperature is above the temperature at which dry cooling of the heat exchange fluid is adequate, and means for evaporatively cooling the water.

5. System according to claim 4, wherein the means for directing a heat exchange fluid from the power plant in a closed cycle through less than the total number of cooling channels in each cooling tower comprises an inlet and an outlet header respectively overlying and underlying the cooling tubes, said headers including openings therein registering with alternate cooling channels and wherein the means for directing water through the remaining cooling channels comprises inlet pipes having branches leading to the several water augmentation channels near the top thereof and outlet pipes having branches leading away from the said water augmentation channels.

* * * * *